United States Patent [19]

Dusart

[11] 4,188,063

[45] Feb. 12, 1980

[54] HAMMOCK CHAIR WITH BACK SUPPORTING MEANS

[76] Inventor: Etienne R. Dusart, 4C Continental Villa, Carolina, P.R.

[21] Appl. No.: 959,085

[22] Filed: Nov. 9, 1978

[51] Int. Cl.[2] ..... A47D 13/10

[52] U.S. Cl. ..... 297/273; 5/122; 297/457

[58] Field of Search ..... 5/120, 122, 123, 127; 297/273, 274, 276, 281, 454, 457; D6/53

[56] References Cited

U.S. PATENT DOCUMENTS

| | | | |
|---|---|---|---|
| 203,795 | 5/1878 | Sutton | 5/122 |
| 667,228 | 2/1901 | Knoernschild | 5/122 |
| 751,907 | 2/1904 | Furst | 5/122 |
| 2,722,968 | 11/1955 | Smith | 5/122 X |
| 3,711,156 | 1/1973 | Bloomfield | 297/457 |

*Primary Examiner*—James C. Mitchell

*Attorney, Agent, or Firm*—Scrivener, Parker, Scrivener and Clarke

[57] ABSTRACT

A hammock chair which is adapted to be suspended and in which a person is seated has a seat part including a back supporting part, and means are provided by which an inwardly projecting ridge is formed in the back supporting part which extends transversely of the suspended chair to provide support to the small of the back of the user.

6 Claims, 16 Drawing Figures

HAMMOCK CHAIR WITH BACK SUPPORTING MEANS

BACKGROUND OF THE INVENTION

It is known in the pertinent arts to provide a suspended hammock chair on which a person may be seated. Such hammock chairs are of two general types, one of which has a seat and back part made of woven or fabric material and also having a plurality of strands extending upwardly from each side of the seat and back part to a supporting means, and the other being formed entirely of woven or fabric material and connected directly to a supporting means without the intervention of of the separate strands.

In FIG. 1 of the drawings there is illustrated a hammock chair of the first type. This chair is constructed and intended to be suspended above the ground or other surface by means which may take the form of a horizontal bar 2 to the ends of which are connected fabric or other strands 4, 6 which extend upwardly from the ends of the bar for connection to a single support 8 or to two separate supports 8*a* and 8*b*. The chair itself comprises seat part 10 which is formed of woven or fabric material which is shaped to provide a lower portion 12 on which the lower part of the body rests, a back part 14 against which the back of the user rests, and side parts 16, 18. Each side part has an upper edge and to each of these edges there are connected in any suitable manner flexible strands 20, 22 which converge upwardly from the edges for connection to the ends of the bar 2 whereby the chair may be suspended.

In FIG. 2 of the drawings there is illustrated the second type of hammock chair to which the invention relates. In this type the entire chair 30 is formed of woven or fabric material, usually in the form of a rectangular sheet the side edges of which are gathered and attached to the ends of the bar 2. This chair, like that of FIG. 1, has a lower part 12 and a back part 14.

In this specification the terms "woven material" and "fabric" are used to denote different materials which are used in the manufacture of hammock chairs. The word "woven material" refers to a material in which the strand or yarn is allowed to move freely along its length, such as in the single weave, double weave and triple weave designs, while "fabric" may be of crisscross type (known as clothe), hexagon type, (known as nylon net) or rhombos type, with macrame knots or nylon net. These terms are known in the art and need not be further explained.

SUMMARY OF THE INVENTION

The seat and back part, or the suspending means, or both, of a hammock chair are so constructed that an inwardly projecting transverse ridge is formed in the back supporting part of the seat which conforms the back supporting part to the body of the user and provides additional support to the small of the back of the seated person.

DESCRIPTION OF THE INVENTION

Means are provided by the invention for producing in the part of the seat of a hammock chair against which the back of the user rests an inwardly projecting ridge which extends from side to side of the hammock seat and which is located at the are of the small of the back of the user. This may be accomplished in several ways according to the invention and, in general, it is accomplished by modifying the construction of the seat of the hammock chair or by modifying the suspending means for the hammock chair, or by modifying both of these.

Figure 1:
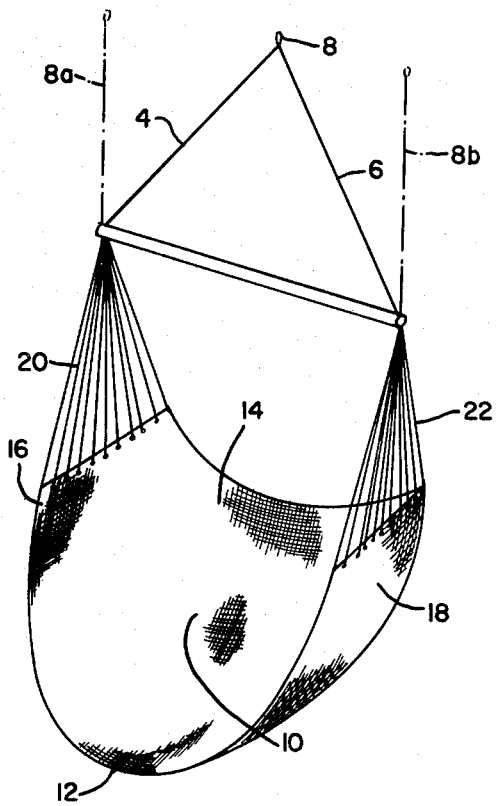
FIGS. 1 and 2 are perspective views of two types of hammock chair to which the invention relates.
Figure 3:
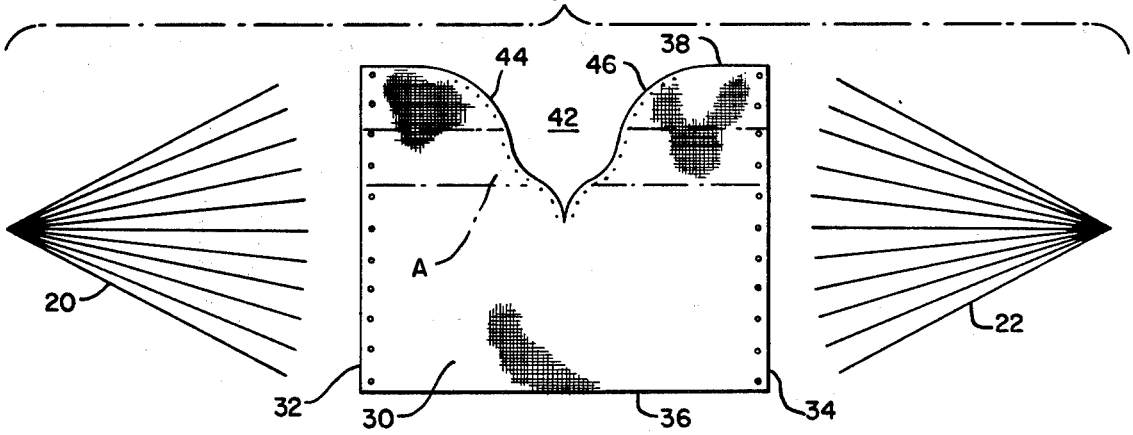
FIGS. 3, 4 and 5 show successive steps in making a hammock chair embodying the invention.
Figure 4:
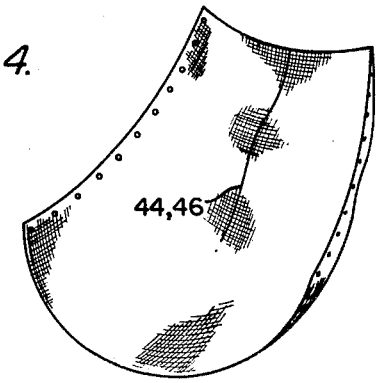
Figure 5:
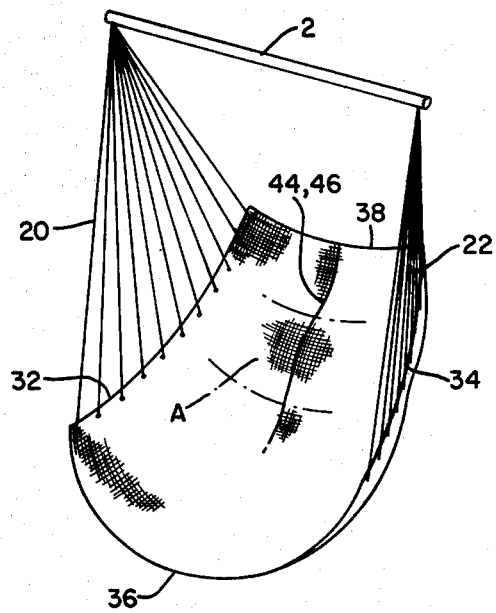
Figure 6:
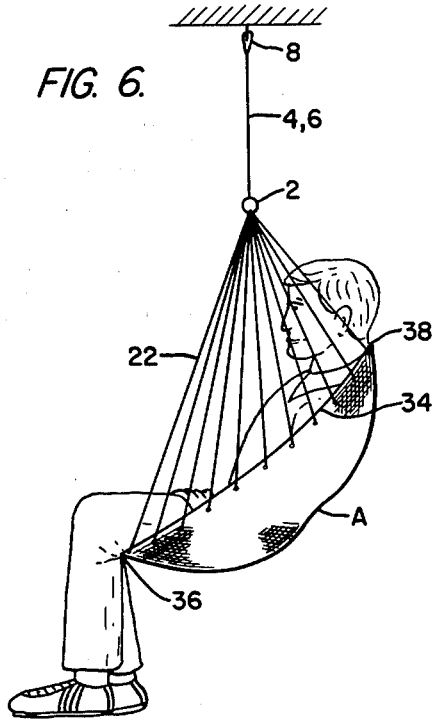
FIG. 6 is a schematic view showing the effect of the invention on a hammock chair and the user.

In FIGS. 3, 4 and 5 there is disclosed one means by which the ridge may be formed in a hammock chair of the type shown in FIG. 1, by modification of the seat part of the hammock chair. In this form of the invention the seat is formed by a generally rectangular sheet of fabric 30 having side edges, 32, 34 and front and rear edges 36, 38, respectively. Strands 20, 22 are provided at each side of the seat and have their inner ends connected to the side edges 32, 34 of the seat part to provide the suspension means which are shown at 20, 22 in FIG. 1. A generally V-shaped opening 42 is made in the seat part 30 and is located centrally between the side edges 32, 34 and extends inwardly from the rear edge 38. Each of the side edges 44, 46 of this V-shaped opening is undulating in shape and these side edges are mirror images of each other. That area of the back supporting part of the seat which will engage the small of the back of the user is the area between the dot-dash lines shown in FIG. 3, and the sides of the V-shaped opening in the area between these lines are curved away from each other. In order to form the seat and to provide the inwardly extending ridge according to the invention the side edges 44, 46 of the V-shaped opening are connected together as by sewing, as shown in FIG. 4. The outer ends of the strands 20, 22 are connected to the ends of the bar 2 and when the user sits in the chairs the area of the seat part which engages the small of the back of the user will form an inwardly projecting ridge A providing additional support to the small of the back because of the shape of the side edges 44, 46 of the V-shaped opening 42 after connection of those side edges. The inwardly projecting ridge, its location in the back supporting part of the hammock chair, and its location at the area of the small of the back of the user are illustrated in FIG. 6.

Figure 7:
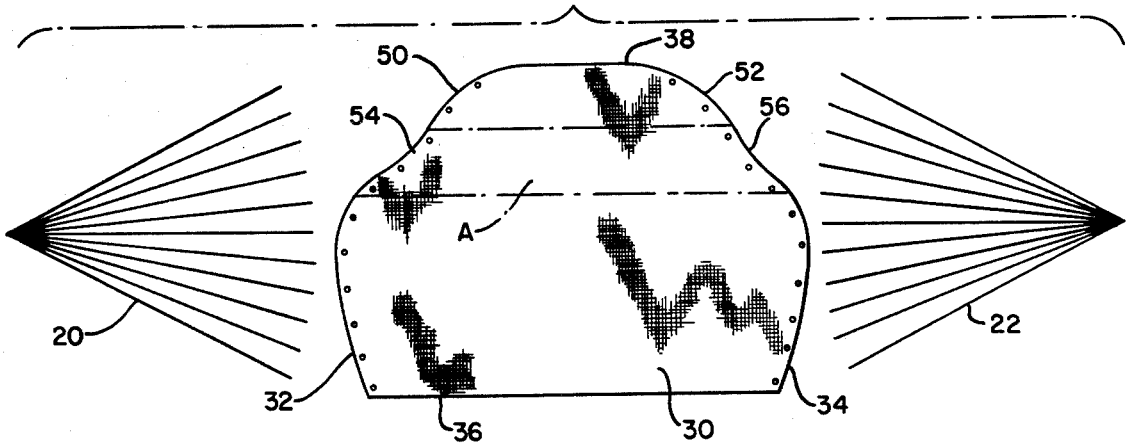
FIGS. 7 and 8 show successive steps in making a hammock chair in accordance with another embodiment of the invention.
Figure 8:
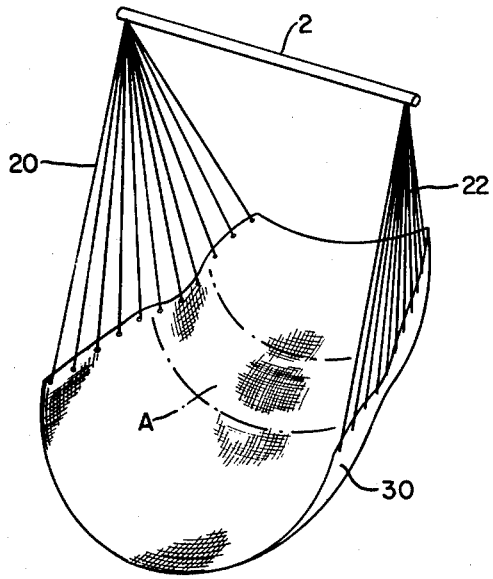

A second form which the invention may take in order to accomplish its object is disclosed in FIGS. 7 and 8. In this embodiment the woven material or fabric seat part 30, is, again, generally rectangular in shape having side edges 32, 34 and front and rear edges 36, 38 as in the form of the invention described above. The corners of the seat part 30 are cut off adjacent the rear edge 38 along diagonal lines extending toward the side edges 32, 34, the resulting diagonal edges 50, 52 being inclined to the side edges and to the front and rear edges at approximately 45 degrees. These diagonal edges are of undulating shape and within the area to be engaged by the small of the back of the user, which is the area between the dot-dash lines in FIG. 7, the edges 50, 52 are curved toward each other as shown at 54, 56. In this form of the invention the suspending strands 20, 22 are all of the same length and their inner ends are attached to the side edges of the seat part 30 throughout the entire length of each side edge including the parts 50, 52, 54, 56. The outer ends of the suspending strands are brought together and connected to the ends of the suspension bar 2. When a user is seated in the chair the effect of the shape of the inclined side edges 50, 52 and their connection to the strands 20, 22 of equal length is to produce at the area of the small of the back of the user the inwardly projecting transverse ridge A according to the invention.

Figure 10:
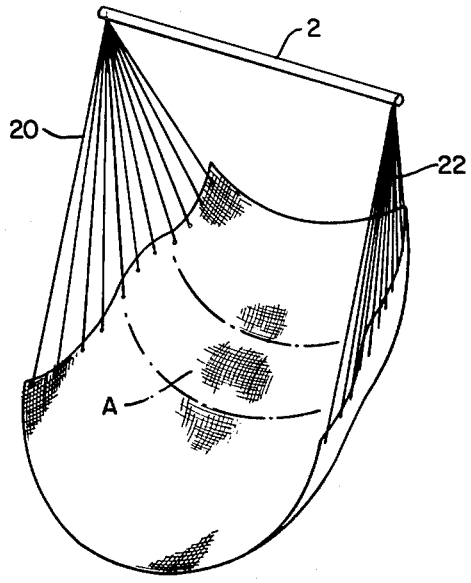
FIGS. 9 and 10 show successive steps in making a hammock chair in accordance with another embodiment of the invention.
Figure 9:
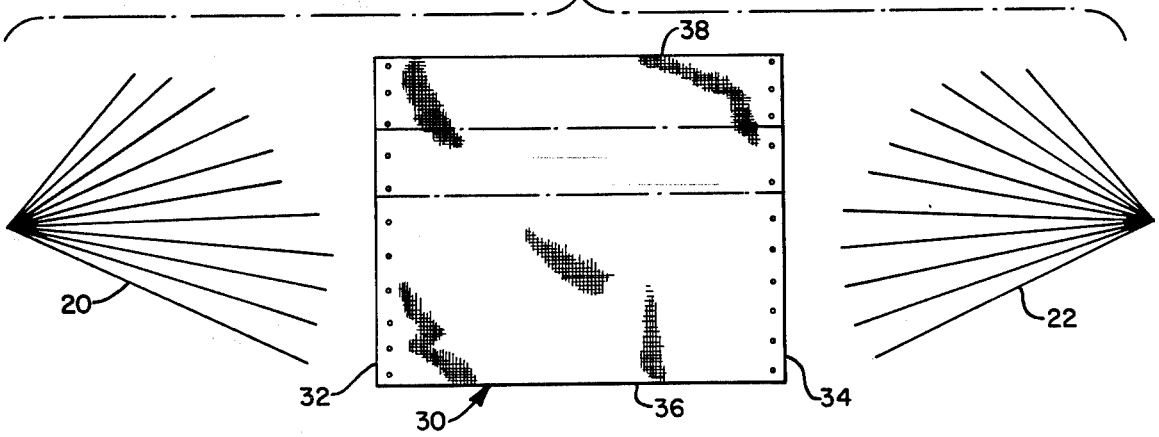

A third form which the invention may take is disclosed in FIGS. 9 and 10. In this form of the invention the ridge A is produced by adjustment of the length of the suspending strands 20, 22 rather than by the shape of the seat part 30. In this form of the invention the seat part, which may be formed of woven material or fabric, has the usual side edges 32, 34 and the front and rear edges 36, 38 and these are not modified, whereby the seat part is rectangular in shape. The suspension strands 20 connected to one side edge 32 of the seat part are of the same length as the corresponding strands 22 which are connected to the other side edge 34. The strands 20 connected to one side edge 32 are of different lengths, those connected to the side edge between the dot-dash lines in FIG. 9 being shorter than the others. Each of the strands 22 connected to the other side edge 34 is the same length as the strand connected to the side edge 32 at the same position along the side edge 32 and the strands connected to the side edge 34 between the dot-dash lines are shorter than the other strands connected to the same side edge and are equal in length to those connected to side edge 34 between the dot-dash lines. The resulting hammock chair is illustrated in FIG. 10 and it will be seen that the ridge A is formed at the area in contact with the small of the back of the user.

Figure 2:
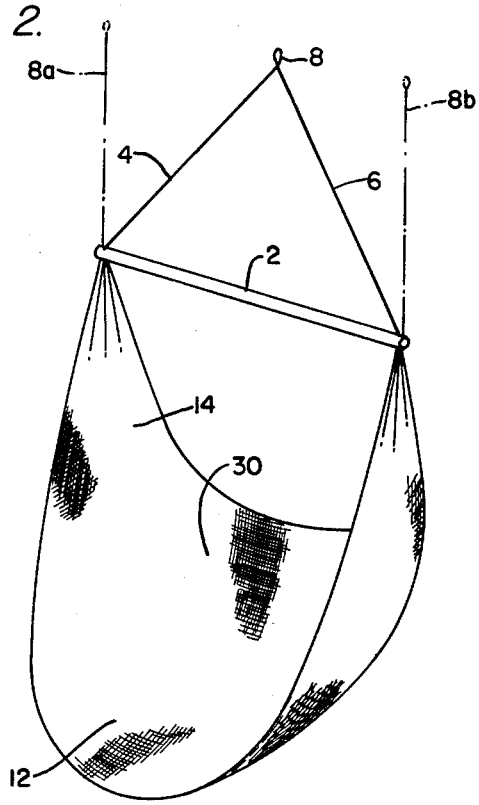
Figure 11:
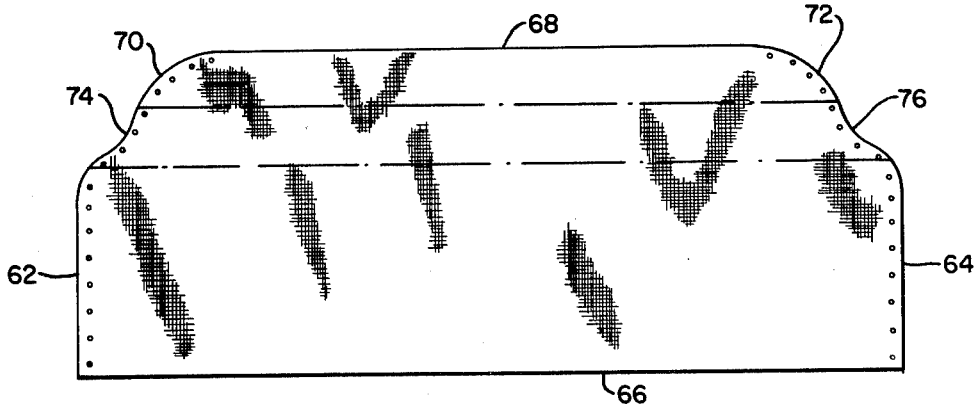
FIGS. 11, 12 and 13 show successive steps in making a hammock chair of the type illustrated in FIG. 2.
Figure 12:
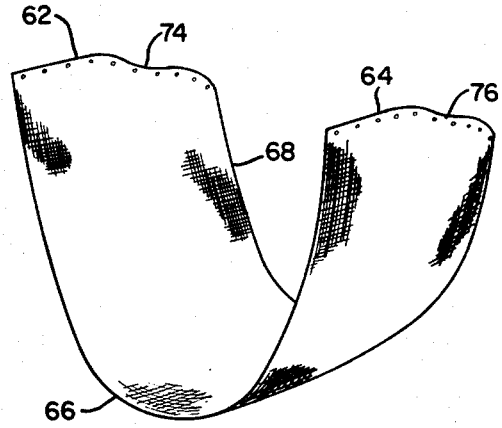
Figure 13:
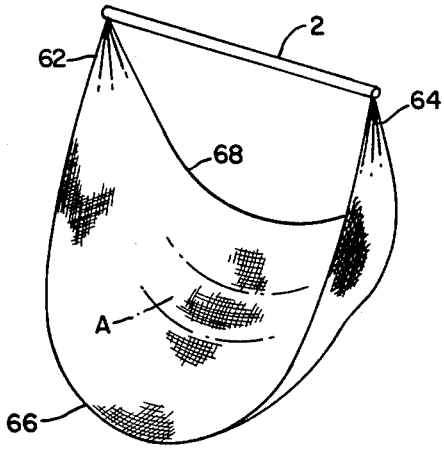

The invention is also applicable to hammock chairs of the type disclosed in FIG. 2 in which the entire chair is formed of woven material or fabric and there are no separate strands connecting the seat part to the suspension means, an embodiment of this form of the invention being disclosed in FIGS. 11, 12 and 13. FIG. 11 discloses the entire hammock chair except only the horizontal bar 2 and the suspension means 4, 6, 8 as shown in FIG. 2. The hammock in the form of the invention comprises the rectangular sheet of woven material or fabric having side edges 62, 64 and front and rear edges 66, 68 the woven material or fabric piece being rectangular in shape and of greater width than depth. In order to produce the inwardly extending ridge A in accordance with the invention the corners of the woven material or fabric sheet are cut off along lines 70, 72 which extend from rear edge 68 in an angular direction toward the opposite side edges. The diagonal edges which are so produced are of undulating shape and at the ends of the area between the dot-dash lines, which is the area which will engage the small of the back of the user, these edges are inwardly curved toward each other as shown at 74, 76. In order to form the hammock the side edges of the sheet are brought toward each other as shown in FIG. 12 and each edge is then gathered and attached to one end of the horizontal bar 2 which forms part of the suspension means. When this is done the inwardly projecting ridge A will be formed and will extend transversely of the hammock chair as shown in FIG. 13.

Figure 14:
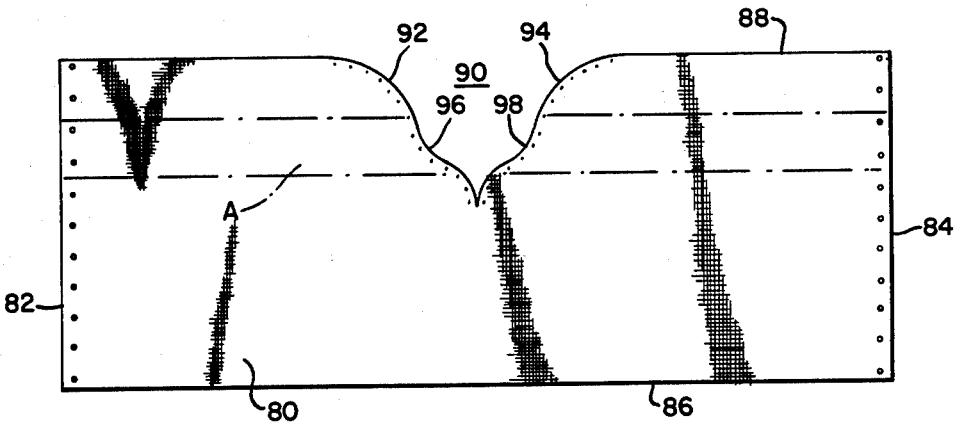
FIGS. 14, 15, and 16 show other successive steps in making a hammock chair of the type illustrated in FIG. 2.
Figure 15:
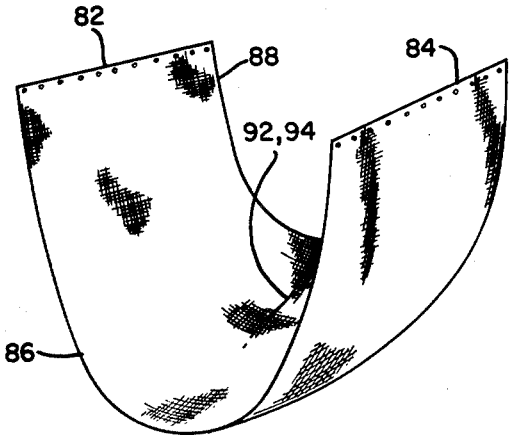
Figure 16:
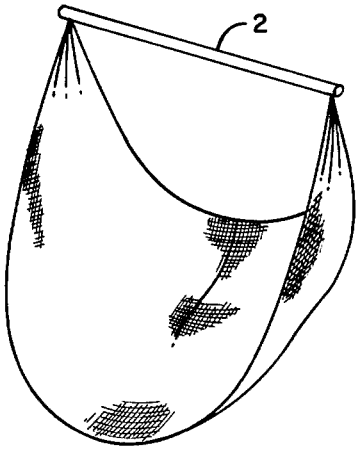

The ridge may be formed in a hammock chair of the type illustrated in FIG. 2 in other ways, one of which is disclosed in FIGS. 14, 15 and 16. In this case the entire hammock chair is formed of a generally rectangular sheet 80 of fabric having side edges 82, 84 and front and rear edges 86, 88. In this embodiment a V-shaped opening 90 is formed in the fabric sheet extending from the center of the rear edge 88 along diagonal lines 92, 94 converging toward the center of the sheet and each of which is of undulating shape. Within the area to be engaged by the small of the back of the user, which is the area between the dot-dash lines in FIG. 14, the diagonal edges are curved away from each other as shown at 96, 98. These diagonal edges 92, 94 are sewed together, as shown in FIG. 15 and each of the side edges of the sheet is gathered and connected to one of the ends of the bar 2 of the suspension means as shown in FIG. 16, thus forming the inwardly projecting transverse ridge A provided by the invention.

I claim:

1. A suspendable hammock chair for supporting a seated person, comprising a seat part having a part adapted to engage the back of the user, and means forming in the back engaging part a ridge projecting inwardly and extending transversely of the chair at the area of the seat part engaged by the small of the back of the user.

2. A suspendable hammock chair according to claim 1, in which the seat part has front and rear edges and side edges and a plurality of strands connected to each side edge for suspending the seat part, the rear edge having a section cut out therefrom approximately midway between the side edges, the cut out section being substantially triangular in shape with its base in the aft edge and its apex adjacent the center of the seat part, the side edges of the cut out section having the same undulating shape with outwardly curved parts between their ends in the region of the seat part which engages the small of the back of the user, and the edges of the cut out section being connected as by sewing.

3. A suspendable hammock chair according to claim 1, in which the seat part has front and rear edges and side edges and a plurality of strands connected to each side edge for suspending the seat part, the corners of the seat part adjacent the aft edge being cut away along diagonal lines of undulating shape with facing outwardly curved parts in the region of the seat part which engages the small of the back of the user, and the side edges being connected to the strands along the undulating parts and the un-cut parts.

4. A hammock seat according to claim 1, in which the seat part is a generally rectangular sheet of woven material having spaced parallel front and rear edges and spaced parallel side edges, and the suspension means comprises two groups of separate strands, those of each group being connected together at their ends and radiating therefrom to one of the side edges of the seat part and connected thereto, those strands of each group which are connected to that part of the seat part which engages the small of the back of the user being shorter than the other strands of the same group thereby forming the ridge, and corresponding strands of the two groups being of the same length.

5. A hammock chair according to claim 1, in which the entire chair is formed of a rectangular sheet of woven material having front and rear edges and side edges and each of the side edges is gathered for attachment to the suspension means, each corner of the sheet being cut away along a diagonal line which extends from the rear edge to a side edge and is of undulating shape with facing inwardly extending curved parts in the area of the back part which is engaged by the small of the back of the user.

6. A hammock chair according to claim 1, in which the entire chair is formed of a rectangular sheet of woven material having front and rear and side edges and each of the side edges is gathered for attachment to the suspension means, the sheet having a triangular section cut therefrom adjacent center of the rear edge and defined by edges of undulating shape converging toward the center of the sheet and having facing inwardly extending curved parts in the area of the back part which is engaged by the small of the back of the user, the undulating edges being connected throughout their lengths as by sewing.

* * * * *